US010715907B2

(12) United States Patent
Ji et al.

(10) Patent No.: US 10,715,907 B2
(45) Date of Patent: Jul. 14, 2020

(54) SPEAKER UNIT, SPEAKER SYSTEM, AND METHOD FOR ADJUSTING VIBRATION DISPLACEMENT OF VIBRATION DIAPHRAGM

(71) Applicant: Goertek Inc., Shandong (CN)

(72) Inventors: Pengcheng Ji, Shandong (CN); Xinfeng Yang, Shandong (CN)

(73) Assignee: Goertek, Inc., Shandong (CN)

( * ) Notice: Subject to any disclaimer, the term of this patent is extended or adjusted under 35 U.S.C. 154(b) by 0 days.

(21) Appl. No.: 16/138,808

(22) Filed: Sep. 21, 2018

(65) Prior Publication Data

US 2019/0037304 A1 Jan. 31, 2019

Related U.S. Application Data

(63) Continuation of application No. PCT/CN2016/082370, filed on May 17, 2016.

(30) Foreign Application Priority Data

Mar. 21, 2016 (CN) ..... 2016 1 0160944

(51) Int. Cl.
*H04R 1/02* (2006.01)
*H04R 9/02* (2006.01)
(Continued)

(52) U.S. Cl.
CPC ..... *H04R 1/2811* (2013.01); *H04R 1/025* (2013.01); *H04R 3/007* (2013.01); *H04R 9/025* (2013.01);
(Continued)

(58) Field of Classification Search
CPC ..... H04R 1/2811; H04R 9/025; H04R 1/025; H04R 7/04; H04R 9/06; H04R 29/003; H04R 3/007; H04R 2209/041; H04R 9/02
See application file for complete search history.

(56) References Cited

U.S. PATENT DOCUMENTS 6,639,994 B1 * 10/2003 Proni ..... H04R 3/002 381/406
7,266,213 B2 * 9/2007 Furuya ..... H04R 7/18 381/189
(Continued)

FOREIGN PATENT DOCUMENTS

CN 201667712 U 12/2010
CN 104640051 A 5/2015
(Continued)

OTHER PUBLICATIONS

First office action of Application No. CN2016101609444, pp. 1-9., dated Mar. 29, 2018 (7 pages).
(Continued)

*Primary Examiner* — Brian Ensey
(74) *Attorney, Agent, or Firm* — Patent Law Works LLP

(57) ABSTRACT

The present invention discloses a speaker unit, a speaker system, and a method for adjusting a vibration displacement of a vibration diaphragm. The method for adjusting a vibration displacement of a vibration diaphragm comprises: obtaining a vibration displacement of a vibration diaphragm; when the vibration displacement is less than a designed amplitude of the vibration diaphragm, increasing an output voltage output by a smart PA to a vibration voice coil till the vibration displacement is equal to the designed amplitude; when the vibration displacement is equal to the designed amplitude, maintaining the output voltage output by the smart PA to the vibration voice coil to enable the vibration displacement to be equal to the designed amplitude; and when the vibration displacement is greater than the designed amplitude, reducing the output voltage output by the smart PA to the vibration voice coil.

10 Claims, 4 Drawing Sheets

(51) Int. Cl.

| | |
|---|---|
| ***H04R 1/28*** | (2006.01) |
| ***H04R 3/00*** | (2006.01) |
| ***H04R 29/00*** | (2006.01) |
| *H04R 9/06* | (2006.01) |
| *H04R 7/04* | (2006.01) |

(52) U.S. Cl.
CPC ..... *H04R 29/003* (2013.01); *H04R 7/04* (2013.01); *H04R 9/06* (2013.01)

(56) References Cited

U.S. PATENT DOCUMENTS

| | | | | |
|---|---|---|---|---|
| 9,049,523 | B2 * | 6/2015 | Bose | G01D 5/2417 |
| 9,485,576 | B2 * | 11/2016 | Gautama | H04R 3/002 |

FOREIGN PATENT DOCUMENTS

| | | | |
|---|---|---|---|
| CN | 104780489 | A | 7/2015 |
| CN | 204906666 | U | 12/2015 |
| CN | 205864719 | U | 1/2017 |

OTHER PUBLICATIONS

International Search Report and Written Opinion, PCT/CN2016/082370, dated Dec. 15, 2016 (23 pages).

* cited by examiner

SPEAKER UNIT, SPEAKER SYSTEM, AND METHOD FOR ADJUSTING VIBRATION DISPLACEMENT OF VIBRATION DIAPHRAGM

CROSS-REFERENCE TO RELATED APPLICATIONS

This application is a Continuation of International Application No. PCT/CN2016/082370, filed on May 17, 2016, which claims priority to Chinese Patent Application No. 201610160944.4, filed on Mar. 21, 2016, both of which are hereby incorporated by reference in their entireties.

FIELD OF THE INVENTION

The present invention relates to the field of electroacoustics, and in particular, to a speaker unit, a speaker system to which the speaker unit is applied, and a method for adjusting a vibration displacement of a vibration diaphragm.

BACKGROUND OF THE INVENTION

As sound generation devices used in electronic products such as mobile phones, televisions, and computers, speakers are widely applied in people's daily production and life. At present, common speakers mainly comprise moving-coil speakers, electromagnetic speakers, capacitive speakers, piezoelectric speakers, and the like. The moving-coil speakers are widely applied because of the characteristics such as relatively simple fabrication, low costs, and desirable low-frequency sound generation advantages.

An existing moving-coil speaker usually comprises a speaker module housing and a speaker unit. A typical structure of the speaker unit comprises a vibration system, a magnetic circuit system, and an auxiliary system. The auxiliary system usually comprises a housing that can accommodate the vibration system and the magnetic circuit system. The vibration system comprises a vibration diaphragm, a vibration voice coil fixed on a side of the vibration diaphragm, and a dome (rounded roof portion) fixed at the center position of the vibration diaphragm. The magnetic circuit system comprises a frame and a magnet and a washer that are fixed on the frame.

To improve the acoustic performance of a speaker and prevent a speaker from damages, smart PAs (smart power amplifiers) are increasingly applied to the field of speakers. A smart PA increases an output voltage output to a vibration voice coil to increase a vibration displacement of a vibration diaphragm, and a waveform returned by the vibration voice coil can be monitored. In an algorithm processing mechanism, the output voltage output to the vibration voice coil is analyzed and adjusted according to the waveform of an electrical signal, so as to achieve the objective of protecting the vibration diaphragm while increasing the volume of a speaker. In particular, to prevent a voltage value output by the smart PA from becoming excessively large to cause an excessively large vibration displacement of the vibration diaphragm, an upper limit value of the output voltage is preset in the algorithm processing mechanism of the smart PA. The algorithm processing mechanism ensures that the vibration displacement of the vibration diaphragm under the effect of the output voltage output to the vibration voice coil remains less than a preset safe displacement. In this method, an actual value of the vibration displacement of the vibration diaphragm is not used, so that an actual vibration displacement of the vibration diaphragm may be less than or even greater than an amplitude of the vibration diaphragm. As a result, the performance of the vibration diaphragm cannot be maximized, and the acoustic performance of a speaker is directly affected. Moreover, when an actual displacement is excessively large and fails to be effectively recognized by using this method, the vibration diaphragm may also fail, and the speaker may consequently fail.

SUMMARY OF THE INVENTION

One objective of the present invention is to provide a method for adjusting a vibration displacement of a vibration diaphragm, so as to maximize the performance of the vibration diaphragm under the premise of protecting a vibration diaphragm, thereby improving the acoustic performance of a speaker.

According to a first aspect of the present invention, a method for adjusting a vibration displacement of a vibration diaphragm is provided, comprising:

obtaining a vibration displacement of a vibration diaphragm;

when the vibration displacement of the vibration diaphragm is less than a designed amplitude of the vibration diaphragm, increasing an output voltage output by a smart PA to a vibration voice coil till the vibration displacement of the vibration diaphragm is equal to the designed amplitude of the vibration diaphragm;

when the vibration displacement of the vibration diaphragm is equal to the designed amplitude of the vibration diaphragm, maintaining the output voltage output by the smart PA to the vibration voice coil to enable the vibration displacement of the vibration diaphragm to be equal to the designed amplitude of the vibration diaphragm; and when the vibration displacement of the vibration diaphragm is greater than the designed amplitude of the vibration diaphragm, reducing the output voltage output by the smart PA to the vibration voice coil.

Preferably, the obtaining a vibration displacement of a vibration diaphragm comprises:

obtaining a current change rate in the vibration voice coil and an induced electromotive force generated in a fixed voice coil due to a current change in the vibration voice coil;

obtaining a distance between the vibration voice coil and the fixed voice coil based on the induced electromotive force and the current change rate in the vibration voice coil; and obtaining the vibration displacement of the vibration diaphragm based on the distance between the vibration voice coil and the fixed voice coil.

Preferably, the designed amplitude of the vibration diaphragm is 80% of an amplitude of the vibration diaphragm.

Preferably, when the vibration displacement of the vibration diaphragm is greater than the designed amplitude of the vibration diaphragm, the output voltage output by the smart PA to the vibration voice coil is first reduced till the vibration displacement of the vibration diaphragm is 0.02 mm less than the designed amplitude of the vibration diaphragm, and the output voltage output by the smart PA to the vibration voice coil is then increased till the vibration displacement of the vibration diaphragm is equal to the designed amplitude of the vibration diaphragm.

Another objective of the present invention is to provide a speaker unit, so as to collect more conveniently an induced electromotive force generated in a fixed voice coil due to a current change in a vibration voice coil, thereby directly obtaining a vibration displacement of a vibration diaphragm.

According to a second aspect of the present invention, a speaker unit provided in the present invention comprises a vibration system, a magnetic circuit system, an auxiliary system, and a fixed voice coil, wherein the vibration system comprises a vibration diaphragm, a vibration voice coil fixed on a side of the vibration diaphragm, and a dome fixed at the center position of the vibration diaphragm, the magnetic circuit system comprises a frame and a magnet and a washer that are fixed on the frame, the auxiliary system comprises a housing used to accommodate the vibration system and the magnetic circuit system, and the fixed voice coil surrounds the magnet of the magnetic circuit system, and is fixedly connected to the frame of the magnetic circuit system.

Preferably, the shape of the fixed voice coil matches the shape of the vibration voice coil of the vibration system.

Preferably, a side wall extending in a direction toward the vibration voice coil is disposed on an edge of the frame.

Preferably, a fixed-voice-coil welding pad is disposed on a surface, near the frame, of the housing, and the fixed voice coil is connected to the fixed-voice-coil welding pad through a lead.

Still another objective of the present invention is to provide a speaker system, so as to increase more conveniently an output voltage output by a smart PA to a vibration voice coil, thereby maximizing the performance of a vibration diaphragm and improving the acoustic performance of a speaker.

According to a third aspect of the present invention, a speaker system provided in the present invention comprises a vibration diaphragm control module, a smart PA, and the speaker unit of the present invention, wherein the vibration diaphragm control module is configured to: collect a current in a vibration voice coil to obtain a current change rate in the vibration voice coil and an induced electromotive force generated in a fixed voice coil due to a current change in the vibration voice coil, obtain a distance between the vibration voice coil and the fixed voice coil based on the induced electromotive force and the current change rate in the vibration voice coil, and obtain a vibration displacement of the vibration diaphragm based on the distance between the vibration voice coil and the fixed voice coil; and is further configured to: when the vibration displacement of the vibration diaphragm is less than a designed amplitude of the vibration diaphragm, send a signal of increasing an output voltage output by the smart PA to the vibration voice coil till the vibration displacement of the vibration diaphragm is equal to the designed amplitude of the vibration diaphragm; when the vibration displacement of the vibration diaphragm is equal to the designed amplitude of the vibration diaphragm, send a signal of maintaining the output voltage output by the smart PA to the vibration voice coil to enable the vibration displacement of the vibration diaphragm to be equal to the designed amplitude of the vibration diaphragm; and when the vibration displacement of the vibration diaphragm is greater than the designed amplitude of the vibration diaphragm, send a signal of reducing the output voltage output by the smart PA to the vibration voice coil.

Preferably, the vibration diaphragm control module is further configured to:

when the vibration displacement of the vibration diaphragm is greater than the designed amplitude of the vibration diaphragm, first send a signal of reducing an output voltage output by the smart PA to the vibration voice coil till the vibration displacement of the vibration diaphragm is 0.02 mm less than the designed amplitude of the vibration diaphragm, and then send a signal of increasing the output voltage output by the smart PA to the vibration voice coil till the vibration displacement of the vibration diaphragm is equal to the designed amplitude of the vibration diaphragm.

The inventor of the present invention finds that the problem that the performance of a vibration diaphragm cannot be maximized exists in the prior art. Therefore, the technical task to be accomplished or the technical problem to be resolved in the present invention has never been conceived of or anticipated by a person skilled in the art, and therefore the present invention is a new technical solution.

One beneficial effect of the present invention lies in that in the method for adjusting a vibration displacement of a vibration diaphragm of the present invention, a vibration displacement of a vibration diaphragm and a smart PA are combined, the vibration displacement of the vibration diaphragm is directly monitored, and the vibration displacement of the vibration diaphragm is adjusted based on a designed amplitude of the vibration diaphragm, so that the vibration displacement of the vibration diaphragm can approach an amplitude of the vibration diaphragm, thereby maximizing the performance of the vibration diaphragm under the premise of protecting the vibration diaphragm, and ensuring the acoustic performance of a speaker.

Another beneficial effect of the present invention lies in that in the speaker unit of the present invention, a fixed voice coil is arranged to facilitate more convenient collection of an induced electromotive force generated in the fixed voice coil due to a current change in a vibration voice coil, thereby obtaining more conveniently a vibration displacement of a vibration diaphragm.

Still another beneficial effect of the present invention lies in that in the speaker system of the present invention, a vibration diaphragm control module monitors a vibration displacement of a vibration diaphragm, and adjusts the vibration displacement of the vibration diaphragm according to a designed amplitude of the vibration diaphragm, so that the vibration displacement of the vibration diaphragm can approach an amplitude of the vibration diaphragm, thereby maximizing the performance of the vibration diaphragm under the premise of protecting the vibration diaphragm, and ensuring the acoustic performance of a speaker.

Other features and advantages of the present invention will become apparent from the following detailed description of exemplary embodiments of the present invention with reference to the accompanying drawings.

BRIEF DESCRIPTION OF THE DRAWINGS

The accompanying drawings, which are incorporated in and constitute a part of the description, illustrate embodiments of the present invention and, together with the description thereof, serve to explain the principles of the present invention.

NUMERALS IN THE DRAWINGS

Figure 1:
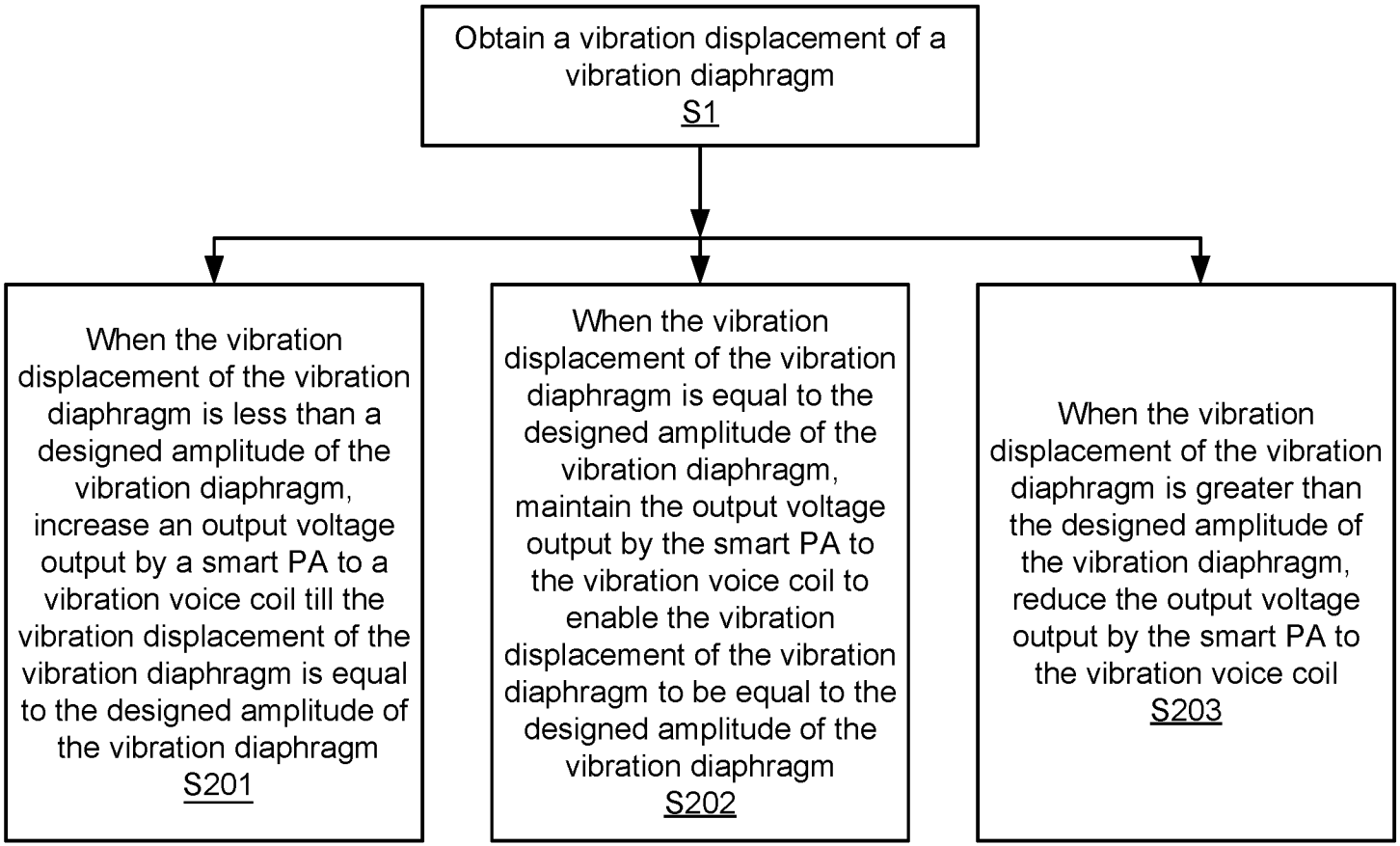
FIG. 1 is a flowchart of a first implementation of a method for adjusting a vibration displacement of a vibration diaphragm according to the present invention.

Speaker unit—1, Vibration diaphragm—11, Vibration voice coil—12, Dome—13, Frame—14, Side wall—141, Magnet—15, Washer—16, Housing—17, Fixed voice coil—18, Lead—181, Vibration diaphragm control module—2, and Smart PA—3.

DETAILED DESCRIPTION OF THE EMBODIMENTS

Various exemplary embodiments of the present invention will now be described in detail with reference to the accompanying drawings. It should be noted that the relative arrangement, numerical expressions and numerical values of the components and steps arrange forth in these examples do not limit the scope of the invention unless otherwise specified.

The following description of at least one exemplary embodiment is in fact merely illustrative and is in no way intended as a limitation to the present invention and its application or use.

Techniques, methods, and apparatus known to those of ordinary skill in the relevant art may not be discussed in detail but wherein appropriate, the techniques, methods, and apparatus should be considered as part of the description.

Among all the examples shown and discussed herein, any specific value should be construed as merely illustrative and not as a limitation. Thus, other examples of exemplary embodiments may have different values.

It should be noted that similar reference numerals and letters denote similar items in the accompanying drawings, and therefore, once an item is defined in a drawing, and there is no need for further discussion in the subsequent accompanying drawings.

To maximize the performance of a vibration diaphragm, the present invention provides a method for adjusting a vibration displacement of a vibration diaphragm. As shown in FIG. 1, the method comprises the following steps:

Step S1: Obtain a vibration displacement of the vibration diaphragm. The vibration displacement of the vibration diaphragm can be obtained in a plurality of manners. For example, a vibration displacement sensor is used to collect vibration displacement data. A person skilled in the art may flexibly select a manner according to an actual requirement.

Step S201: When the vibration displacement of the vibration diaphragm is less than a designed amplitude of the vibration diaphragm, increase an output voltage output by a smart PA to a vibration voice coil till the vibration displacement of the vibration diaphragm is equal to the designed amplitude of the vibration diaphragm. The designed amplitude of the vibration diaphragm refers to a maximum vibration displacement that the vibration diaphragm is allowed to reach while ensuring a safe working condition of the vibration diaphragm. The designed amplitude of the vibration diaphragm is usually less than an amplitude of the vibration diaphragm. Specifically, the range of the designed amplitude of the vibration diaphragm may be selected according to an acoustic performance requirement of a speaker. In addition, to protect the vibration diaphragm and prevent the output voltage output by the smart PA to the vibration voice coil from increasing instantaneously to cause an instantaneous increase of the vibration displacement of the vibration diaphragm, the output voltage output by the smart PA to the vibration voice coil may be gradually increased with equal step size or may be first rapidly increased to a value and then slowly increased to a target value. Moreover, when the vibration displacement of the vibration diaphragm is equal to the designed amplitude of the vibration diaphragm, the output voltage output by the smart PA to the vibration voice coil may be kept to enable the vibration displacement of the vibration diaphragm to be kept at the designed amplitude of the vibration diaphragm.

Step S202: When the vibration displacement of the vibration diaphragm is equal to the designed amplitude of the vibration diaphragm, maintain the output voltage output by the smart PA to the vibration voice coil to enable the vibration displacement of the vibration diaphragm to be equal to the designed amplitude of the vibration diaphragm. During actual application, the output voltage output by the smart PA to the vibration voice coil cannot remain stabilized at a particular value. Therefore, the enabling the vibration displacement of the vibration diaphragm to be equal to the value of an output voltage of the designed amplitude of the vibration diaphragm may be understood as keeping the output voltage vibrating within a particular range. For example, the output voltage vibrates in the form of a sine wave, and the vibration manner of the sine wave keeps the vibration displacement of the vibration diaphragm vibrating within a ±0.02 mm range. Such a vibration manner of the output voltage can further prevent the vibration diaphragm from fatigue damage due to high-amplitude vibration for a long time.

Step S203: When the vibration displacement of the vibration diaphragm is greater than the designed amplitude of the vibration diaphragm, reduce the output voltage output by the smart PA to the vibration voice coil. To better protect the vibration diaphragm and prevent the output voltage output by the smart PA to the vibration voice coil from decreasing instantaneously to cause an instantaneous decrease of the vibration displacement of the vibration diaphragm, the output voltage output by the smart PA to the vibration voice coil may be gradually decreased with equal step size. Certainly, when the vibration displacement of the vibration diaphragm is decreased into a safe range, the output voltage output by the smart PA to the vibration voice coil may further be increased till the vibration displacement of the vibration diaphragm is equal to the designed amplitude of the vibration diaphragm.

Compared with the restriction in the prior art that the output voltage output by the smart PA to the vibration voice coil remains less than a preset upper limit value of the output voltage, in the present invention, the vibration displacement of the vibration diaphragm is monitored in real time, the vibration displacement of the vibration diaphragm is compared with the designed amplitude of the vibration diaphragm, and the output voltage output by the smart PA to the vibration voice coil is adjusted to enable the vibration displacement of the vibration diaphragm to reach the designed amplitude of the vibration diaphragm, so that an actual vibration displacement of the vibration diaphragm can maximally approach an amplitude of the vibration diaphragm within a safe range.

In the method for adjusting a vibration displacement of a vibration diaphragm of the present invention, a vibration displacement of a vibration diaphragm and a smart PA are combined, the vibration displacement of the vibration diaphragm is directly monitored, and the vibration displacement of the vibration diaphragm is adjusted based on a designed amplitude of the vibration diaphragm, so that the vibration displacement of the vibration diaphragm can approach an amplitude of the vibration diaphragm, thereby maximizing the performance of the vibration diaphragm under the premise of protecting the vibration diaphragm, and ensuring the acoustic performance of a speaker.

Figure 2:
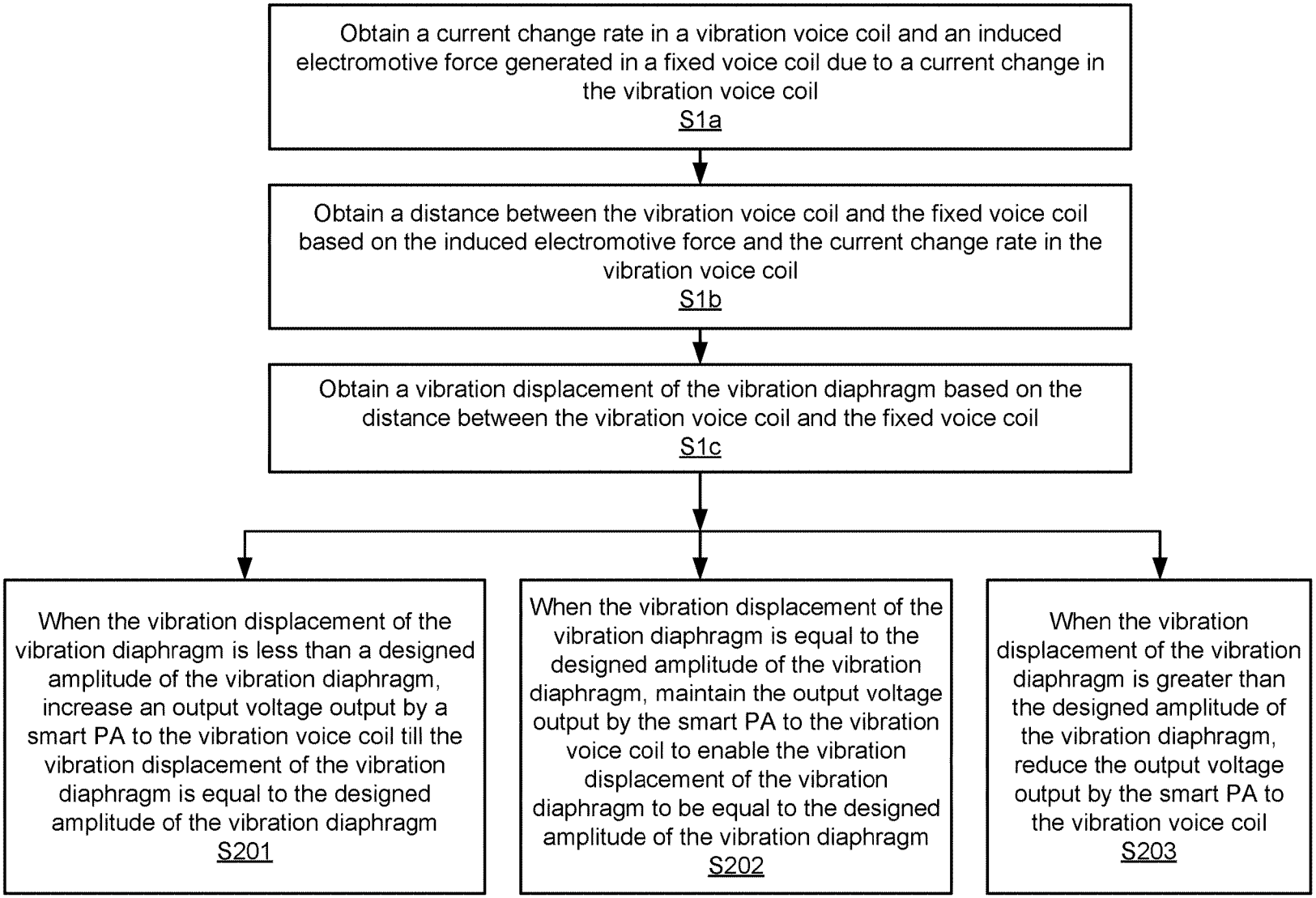
FIG. 2 is a flowchart of a second implementation of a method for adjusting a vibration displacement of a vibration diaphragm according to the present invention.

As shown in FIG. 2, in a preferred embodiment of the present invention, step S1 of obtaining the vibration displacement of the vibration diaphragm may comprise the following steps:

Step S1*a*: Obtain a current change rate in the vibration voice coil and an induced electromotive force generated in a fixed voice coil due to a current change in the vibration voice coil. The current change rate in the vibration voice coil may be implemented by collecting a current flowing in the vibration voice coil within a particular period of time. The fixed voice coil refers to a voice coil structure with a fixed position. When an audio current flows in the vibration voice coil, a magnetic field changing with the audio current is generated. In this case, the magnetic flux of the fixed voice coil changes to generate the induced electromotive force in the fixed voice coil.

Step S1*b*: Obtain a distance between the vibration voice coil and the fixed voice coil based on the induced electromotive force and the current change rate in the vibration voice coil. The process of obtaining the distance between the vibration voice coil and the fixed voice coil may be implemented by using the following manner:

For one speaker unit with a determined structure, a current change rate in a vibration voice coil, the induced electromotive force of the fixed voice coil, and the distance between the vibration voice coil and the fixed voice coil have a fixed relationship. Therefore, one relationship table may be established for the induced electromotive force, the current change rate in the vibration voice coil, and the distance between the vibration voice coil and the fixed voice coil. The relationship table may be obtained through experiments or calculation. A correspondence between the current change rate in the vibration voice coil and the distance between the vibration voice coil and the fixed voice coil at an induced electromotive force may be found by looking up the relationship table. For example, when the induced electromotive force is determined, one value of the distance between the vibration voice coil and the fixed voice coil corresponding to the current change rate in the vibration voice coil may be found by looking up the relationship table.

Certainly, an equation, for example, $$\varepsilon = M * \frac{dI}{dt},$$

of the current change rate in the vibration voice coil, the induced electromotive force of the fixed voice coil, and the distance between the vibration voice coil and the fixed voice coil may be obtained through fitting with related data obtained through experiments, wherein E is the induced electromotive force of the fixed voice coil, M is a function related to the distance between the vibration voice coil and the fixed voice coil, and dI/dt is the current change rate in the vibration voice coil. A component such as a central processing unit processes the obtained induced electromotive force and current in the vibration voice coil to obtain the value of the distance between the vibration voice coil and the fixed voice coil.

Step S1*c*: Obtain the vibration displacement of the vibration diaphragm based on the distance between the vibration voice coil and the fixed voice coil. The position of the fixed voice coil is fixed, and the vibration voice coil vibrates when an audio current passes through. Therefore, the vibration displacement of the vibration diaphragm may be obtained by subtracting the distance between the vibration voice coil and the fixed voice coil before the vibration voice coil is energized from the distance between the vibration voice coil and the fixed voice coil after the vibration voice coil is energized.

In the obtaining of the induced electromotive force and the current change rate in the vibration voice coil, the sensitivity is very high, and an error does not occur easily. Therefore, such a method of obtaining the vibration displacement of the vibration diaphragm has higher sensitivity and reliability than a conventional method of obtaining a vibration displacement by using a vibration displacement sensor, thereby facilitating flexible monitoring of the vibration displacement of the vibration diaphragm.

To better protect the vibration diaphragm while ensuring the condition of maximizing the performance of the vibration diaphragm, the designed amplitude of the vibration diaphragm is 80% of an amplitude of the vibration diaphragm.

In another preferred embodiment of the present invention, step S203 may further comprise the following step:

when the vibration displacement of the vibration diaphragm is greater than the designed amplitude of the vibration diaphragm, first reducing the output voltage output by the smart PA to the vibration voice coil till the vibration displacement of the vibration diaphragm is 0.02 mm less than the designed amplitude of the vibration diaphragm, and then increasing the output voltage output by the smart PA to the vibration voice coil till the vibration displacement of the vibration diaphragm is equal to the designed amplitude of the vibration diaphragm, so that not only the vibration diaphragm is better protected, but also the performance of the vibration diaphragm can be maximized.

Figure 3:
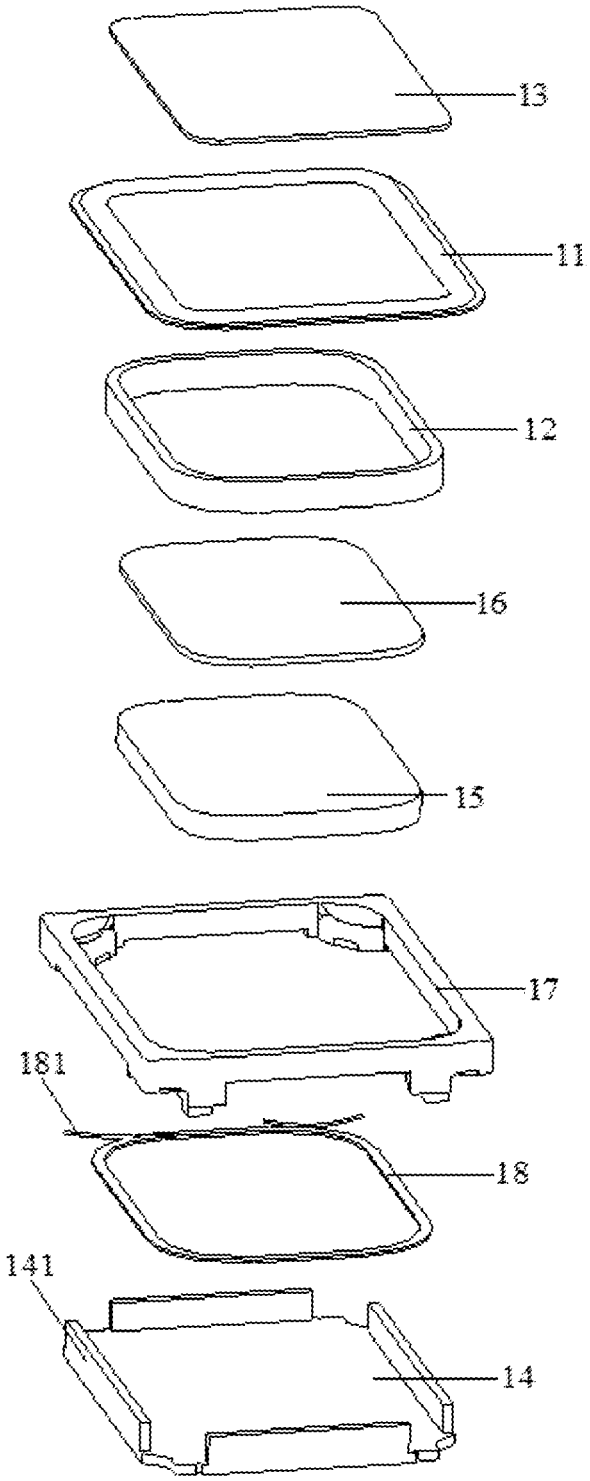
FIG. 3 is an exploded view of an embodiment of a speaker unit according to the present invention.
Figure 4:
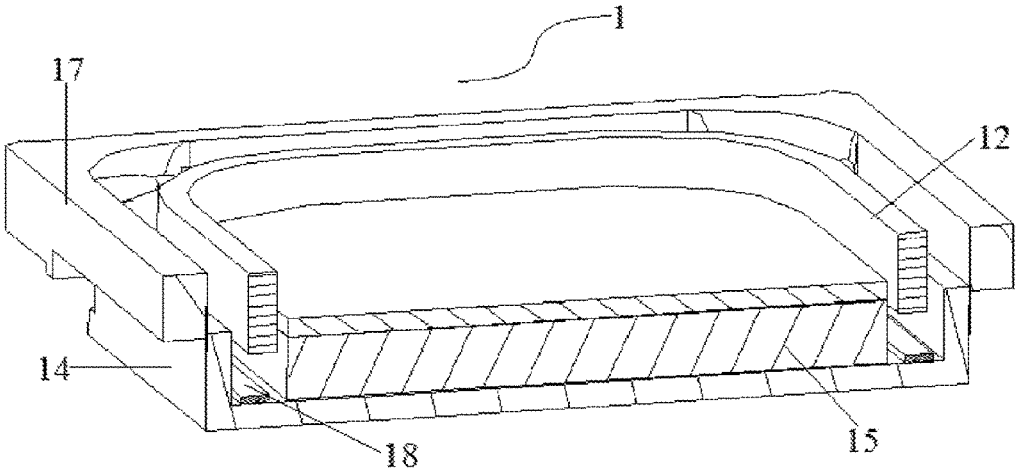
FIG. 4 is a partial sectional view of an embodiment of a speaker unit according to the present invention.

The present invention further provides a speaker unit 1 that can collect and fix more conveniently an induced electromotive force generated in a fixed voice coil due to a current change in a vibration voice coil under the premise of making minimal change to the structure of an existing moving-coil speaker. As shown in FIGS. 3 and 4, the speaker unit of the present invention 1 comprises a vibration system, a magnetic circuit system, an auxiliary system, and a fixed voice coil 18. The vibration system comprises a vibration diaphragm 11, a vibration voice coil 12 fixed on a side of the vibration diaphragm 11, and a dome 13 fixed at the center position of the vibration diaphragm. The magnetic circuit system comprises a frame 14 and a magnet 15 and a washer 16 that are fixed on the frame 14. The auxiliary system comprises a housing 17 used to accommodate the vibration system and the magnetic circuit system. The fixed voice coil 18 surrounds the magnet 15 of the magnetic circuit system, and is fixedly connected to the frame of the magnetic circuit system 14. The fixed connection may be implemented in a manner such as bonding. The fixed voice coil 18 is only used to collect the induced electromotive force. Therefore, the volume of the fixed voice coil 18 can be minimized. To avoid the impact on the structures of other components in the existing moving-coil speaker, the height of the fixed voice coil 18 may be selected to be less than 5 mm.

In the speaker unit of the present invention, a fixed voice coil is arranged to facilitate more convenient collection of an induced electromotive force generated in the fixed voice coil due to a current change in a vibration voice coil, thereby obtaining more conveniently a vibration displacement of a vibration diaphragm.

The obtaining a vibration displacement of the vibration diaphragm 11 may comprise the following steps:

A current change rate in the vibration voice coil 12 and an induced electromotive force generated in the fixed voice coil 18 due to a current change in the vibration voice coil 12 are obtained. The current change rate in the vibration voice coil 12 may be implemented by collecting a current flowing in the vibration voice coil 12 within a particular period of time. When an audio current flows in the vibration voice coil 12, a magnetic field changing with the audio current is generated. In this case, the magnetic flux of the fixed voice coil 18 changes to generate the induced electromotive force in the fixed voice coil 18.

A distance between the vibration voice coil 12 and the fixed voice coil 18 is obtained based on the induced electromotive force and the current change rate in the vibration voice coil 12. The process of obtaining the distance between the vibration voice coil 12 and the fixed voice coil 18 may be implemented by using the following manner:

For one speaker unit 1 with a determined structure, the current change rate in the vibration voice coil 12, the induced electromotive force of the fixed voice coil 18, and the distance between the vibration voice coil 12 and the fixed voice coil 18 have a fixed relationship. Therefore, one relationship table may be established for the induced electromotive force, the current change rate in the vibration voice coil 12, and the distance between the vibration voice coil 12 and the fixed voice coil 18. The relationship table may be obtained through experiments or calculation. A correspondence between the current change rate in the vibration voice coil 12 and the distance between the vibration voice coil 12 and the fixed voice coil 18 at an induced electromotive force may be found by looking up the relationship table. For example, when the induced electromotive force is determined, one value of the distance between the vibration voice coil 12 and the fixed voice coil 18 corresponding to the current change rate in the vibration voice coil 12 may be found by looking up the relationship table.

Certainly, an equation, for example, $$\varepsilon = M * \frac{dI}{dt},$$

of the current change rate in the vibration voice coil 12, the induced electromotive force of the fixed voice coil 18, and the distance between the vibration voice coil 12 and the fixed voice coil 18, may be obtained through fitting with related data obtained through experiments, wherein E is the induced electromotive force of the fixed voice coil 18, M is a function related to the distance between the vibration voice coil 12 and the fixed voice coil 18, and dI/dt is the current change rate in the vibration voice coil 12. A component such as a central processing unit processes the obtained induced electromotive force and current in the vibration voice coil 12 to obtain the value of the distance between the vibration voice coil 12 and the fixed voice coil 18.

The vibration displacement of the vibration diaphragm 11 is obtained based on the distance between the vibration voice coil 12 and the fixed voice coil 18. The position of the fixed voice coil 18 is fixed, and the vibration voice coil 12 vibrates when an audio current passes through. Therefore, the vibration displacement of the vibration diaphragm 11 may be obtained by subtracting the distance between the vibration voice coil 12 and the fixed voice coil 18 before the vibration voice coil 12 is energized from the distance between the vibration voice coil 12 and the fixed voice coil 18 after the vibration voice coil 12 is energized.

In the obtaining of the induced electromotive force and the current change rate in the vibration voice coil 12, the sensitivity is very high, and an error does not occur easily. Therefore, such a method of obtaining the vibration displacement of the vibration diaphragm 11 has higher sensitivity and reliability than a conventional method of obtaining a vibration displacement by using a vibration displacement sensor, thereby facilitating flexible monitoring of the vibration displacement of the vibration diaphragm 11.

To obtain with higher sensitivity the induced electromotive force generated in the fixed voice coil 18 due to a current change in the vibration voice coil 12, the shape of the fixed voice coil 18 matches the shape of the vibration voice coil 12 of the vibration system.

To better position the fixed voice coil 18, a side wall 141 extending in a direction toward the vibration voice coil 12 is disposed on an edge of the frame 14.

To collect and fix more conveniently the induced electromotive force generated in the fixed voice coil 18 due to a current change in the vibration voice coil 12 under the premise of making minimal change to the structure of an existing moving-coil speaker, a fixed-voice-coil welding pad is disposed (not shown in the figure) on a surface, near the frame 14, of the housing 17, and the fixed voice coil 18 is connected to the fixed-voice-coil welding pad through a lead 181.

Figure 5:
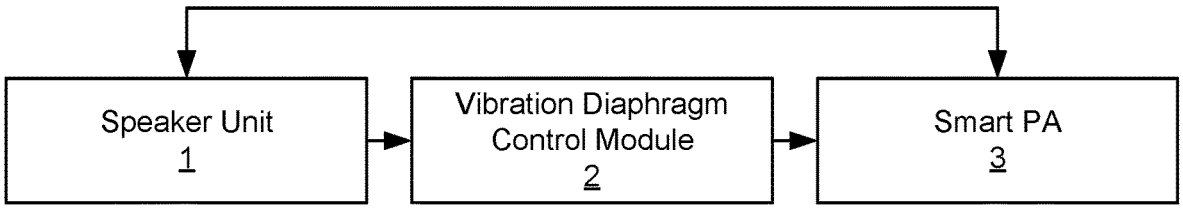
FIG. 5 is a schematic electrical diagram of an embodiment of a speaker system according to the present invention.

The present invention further provides a speaker system. As shown in FIG. 5, the speaker system comprises a vibration diaphragm control module 2, a smart PA 3, and the speaker unit 1 of the present invention.

The vibration diaphragm control module 2 is configured to: collect a current in a vibration voice coil 12 to obtain a current change rate in the vibration voice coil 12 and an induced electromotive force generated in a fixed voice coil 18 due to a current change in the vibration voice coil 12, obtain a distance between the vibration voice coil 12 and the fixed voice coil 18 based on the induced electromotive force and the current change rate in the vibration voice coil 12, and obtain a vibration displacement of the vibration diaphragm 11 based on the distance between the vibration voice coil 12 and the fixed voice coil 18; and is further configured to: when the vibration displacement of the vibration diaphragm 11 is less than a designed amplitude of the vibration diaphragm 11, send a signal of increasing an output voltage output by the smart PA 3 to the vibration voice coil 12 till the vibration displacement of the vibration diaphragm 11 is equal to the designed amplitude of the vibration diaphragm 11; when the vibration displacement of the vibration diaphragm 11 is equal to the designed amplitude of the vibration diaphragm 11, send a signal of maintaining the output voltage output by the smart PA 3 to the vibration voice coil 12 to enable the vibration displacement of the vibration diaphragm 11 to be equal to the designed amplitude of the vibration diaphragm 11; and when the vibration displacement of the vibration diaphragm 11 is greater than the designed amplitude of the vibration diaphragm 11, send a signal of reducing the output voltage output by the smart PA 3 to the vibration voice coil 12. The designed amplitude of the vibration diaphragm 11 refers to a maximum vibration displacement that the vibration diaphragm 11 is allowed to reach while ensuring a safe working condition of the vibration diaphragm 11.

In the speaker system of the present invention, the vibration diaphragm control module 2 monitors the vibration displacement of the vibration diaphragm 11, and adjusts the vibration displacement of the vibration diaphragm 11 according to the designed amplitude of the vibration diaphragm 11, so that the vibration displacement of the vibration diaphragm 11 can approach an amplitude of the vibration diaphragm 11, thereby maximizing the performance of the vibration diaphragm 11 under the premise of protecting the vibration diaphragm 11, and ensuring the acoustic performance of a speaker.

To better protect the vibration diaphragm 11 and further maximize the performance of the vibration diaphragm 11, the vibration diaphragm control module 2 is further configured to: when the vibration displacement of the vibration diaphragm 11 is greater than the designed amplitude of the vibration diaphragm 11, first send a signal of reducing the output voltage output by the smart PA 3 to the vibration voice coil 12 till the vibration displacement of the vibration diaphragm 11 is 0.02 mm less than the designed amplitude of the vibration diaphragm 12, and then send a signal of increasing the output voltage output by the smart PA 3 to the vibration voice coil 12 till the vibration displacement of the vibration diaphragm 11 is equal to the designed amplitude of the vibration diaphragm 11.

While certain specific embodiments of the present invention have been illustrated by way of example, it will be understood by those skilled in the art that the foregoing examples are provided for the purpose of illustration and are not intended to limit the scope of the present invention. It will be understood by those skilled in the art that the foregoing embodiments may be modified without departing from the scope and spirit of the invention. The scope of the present invention is subject to the attached claims.

What is claimed is:

1. A method for adjusting a vibration displacement of a vibration diaphragm, comprising:

obtaining a vibration displacement of a vibration diaphragm;

when the vibration displacement of the vibration diaphragm is less than a designed amplitude of the vibration diaphragm, increasing an output voltage output by a smart PA to a vibration voice coil until the vibration displacement of the vibration diaphragm is equal to the designed amplitude of the vibration diaphragm;

when the vibration displacement of the vibration diaphragm is equal to the designed amplitude of the vibration diaphragm, maintaining the output voltage output by the smart PA to the vibration voice coil to enable the vibration displacement of the vibration diaphragm to be equal to the designed amplitude of the vibration diaphragm; and when the vibration displacement of the vibration diaphragm is greater than the designed amplitude of the vibration diaphragm, reducing the output voltage output by the smart PA to the vibration voice coil.

2. The method for adjusting the vibration displacement of the vibration diaphragm according to claim 1, wherein the obtaining the vibration displacement of the vibration diaphragm comprises:

obtaining a current change rate in the vibration voice coil and an induced electromotive force generated in a fixed voice coil due to a current change in the vibration voice coil;

obtaining a distance between the vibration voice coil and the fixed voice coil based on the induced electromotive force and the current change rate in the vibration voice coil; and obtaining the vibration displacement of the vibration diaphragm based on the distance between the vibration voice coil and the fixed voice coil.

3. The method for adjusting the vibration displacement of the vibration diaphragm according to claim 1, wherein the designed amplitude of the vibration diaphragm is 80% of an amplitude of the vibration diaphragm.

4. The method for adjusting the vibration displacement of the vibration diaphragm according to claim 1, wherein when the vibration displacement of the vibration diaphragm is greater than the designed amplitude of the vibration diaphragm, the output voltage output by the smart PA to the vibration voice coil is first reduced until the vibration displacement of the vibration diaphragm is 0.02 mm less than the designed amplitude of the vibration diaphragm, and then increased until the vibration displacement of the vibration diaphragm is equal to the designed amplitude of the vibration diaphragm.

5. A speaker unit for implementing the method for adjusting a vibration displacement of a vibration diaphragm according to any one of claims 1-4, comprising a vibration system, a magnetic circuit system, an auxiliary system, and a fixed voice coil, wherein the vibration system comprises a vibration diaphragm, a vibration voice coil fixed on a side of the vibration diaphragm, and a dome fixed at a center position of the vibration diaphragm, wherein the magnetic circuit system comprises a frame and a magnet and a washer that are fixed on the frame, the auxiliary system comprises a housing used to accommodate the vibration system and the magnetic circuit system, and the fixed voice coil surrounds the magnet of the magnetic circuit system, and is fixedly connected to the frame of the magnetic circuit system.

6. The speaker unit according to claim 5, wherein a shape of the fixed voice coil matches a shape of the vibration voice coil of the vibration system.

7. The speaker unit according to claim 5, wherein a side wall extending in a direction toward the vibration voice coil is disposed on an edge of the frame.

8. The speaker unit according to claim 5, wherein a fixed-voice-coil welding pad is disposed on a surface, near the frame, of the housing, and the fixed voice coil is connected to the fixed-voice-coil welding pad through a lead.

9. A speaker system, comprising a vibration diaphragm control module, a smart PA, and the speaker unit according to claim 5, wherein the vibration diaphragm control module is configured to: collect a current in the vibration voice coil to obtain a current change rate in the vibration voice coil and an induced electromotive force generated in the fixed voice coil due to a current change in the vibration voice coil, obtain a distance between the vibration voice coil and the fixed voice coil based on the induced electromotive force and the current change rate in the vibration voice coil, and obtain the vibration displacement of the vibration diaphragm based on the distance between the vibration voice coil and the fixed voice coil; and is further configured to: when the vibration displacement of the vibration diaphragm is less than a designed amplitude of the vibration diaphragm, send a signal of increasing an output voltage output by the smart PA to the vibration voice coil until the vibration displacement of the vibration diaphragm is equal to the designed amplitude of the vibration diaphragm; when the vibration displacement of the vibration diaphragm is equal to the designed amplitude of the vibration diaphragm, send a signal of maintaining the output voltage output by the smart PA to the vibration voice coil to enable the vibration displacement of the vibration diaphragm to be equal to the designed amplitude of the vibration diaphragm; and when the vibration displacement of the vibration diaphragm is greater than the designed amplitude of the vibration diaphragm, send a signal of reducing the output voltage output by the smart PA to the vibration voice coil.

10. The speaker system according to claim 9, wherein the vibration diaphragm control module is further configured to:

when the vibration displacement of the vibration diaphragm is greater than the designed amplitude of the vibration diaphragm, first send a signal of reducing the output voltage output by the smart PA to the vibration voice coil until the vibration displacement of the vibration diaphragm is 0.02 mm less than the designed amplitude of the vibration diaphragm, and then send a signal of increasing the output voltage output by the smart PA to the vibration voice coil until the vibration displacement of the vibration diaphragm is equal to the designed amplitude of the vibration diaphragm.

* * * * *